US010550598B2

(12) United States Patent
Sivewright

(10) Patent No.: US 10,550,598 B2
(45) Date of Patent: Feb. 4, 2020

(54) WIRE RETAINING FENCE POST

(71) Applicant: Southern Wire Pty Ltd., Bassendean, Western Australia (AU)

(72) Inventor: Jerry Trevor Sivewright, Bassendean (AU)

(73) Assignee: Southern Wire PTY Ltd., Bassendean, Western Australia (AU)

( * ) Notice: Subject to any disclaimer, the term of this patent is extended or adjusted under 35 U.S.C. 154(b) by 214 days.

(21) Appl. No.: 15/524,255

(22) PCT Filed: Nov. 3, 2015

(86) PCT No.: PCT/AU2015/000663

§ 371 (c)(1),
(2) Date: May 3, 2017

(87) PCT Pub. No.: WO2016/070026

PCT Pub. Date: May 12, 2016

(65) Prior Publication Data

US 2017/0335596 A1 Nov. 23, 2017

(30) Foreign Application Priority Data

| | | |
|---|---|---|
| Nov. 3, 2014 | (AU) | 2014904424 |
| May 14, 2015 | (AU) | 2015100640 |
| Jun. 26, 2015 | (AU) | 2015100851 |

(51) Int. Cl.
*E04H 17/12* (2006.01)
*E04H 17/14* (2006.01)

(52) U.S. Cl.
CPC ..... *E04H 17/12* (2013.01); *E04H 17/14* (2013.01)

(58) Field of Classification Search
CPC ..... E04H 17/02; E04H 17/04; E04H 17/06; E04H 17/10; E04H 17/12; E04H 17/14; E04H 17/24
USPC ..... 256/33, 47, 48, DIG. 3
See application file for complete search history.

(56) References Cited

U.S. PATENT DOCUMENTS

| | | | |
|---|---|---|---|
| 239,083 | A | 3/1881 | Braby et al. |
| 622,345 | A | 4/1899 | Greig et al. |
| 796,313 | A | 8/1905 | Gannaway |
| 841,036 | A | 1/1907 | Morse |

(Continued)

FOREIGN PATENT DOCUMENTS

FR 2516144 * 5/1983

OTHER PUBLICATIONS

International Search Report and Written Opinion dated Nov. 20, 2015 in PCT Application No. PCT/AU2015/000663.

*Primary Examiner* — Jonathan P Masinick
(74) *Attorney, Agent, or Firm* — Hunton Andrews Kurth LLP

(57) ABSTRACT

Described herein are embodiments of a wire retaining fence post adapted to receive a wire fence. The wire retaining fence post includes an elongate body, at least one flange extending from the elongate body, the flange being provided with a wire receiving channel located in a distal edge of the flange, the wire receiving channel being in communication with a wire retaining cavity provided through the flange, and a gate pivotably coupled to the flange across the wire receiving channel, wherein the gate is operable in a closed configuration and an open configuration. The gate is biased towards the closed configuration.

22 Claims, 13 Drawing Sheets

(56) References Cited

U.S. PATENT DOCUMENTS

| | | | | | |
|---|---|---|---|---|---|
| 851,445 | A | | 4/1907 | Seymour | |
| 1,022,314 | A | | 4/1912 | Olden | |
| 3,606,259 | A | | 9/1971 | Bessie et al. | |
| 4,134,575 | A | * | 1/1979 | Chavarria | E04H 17/10 256/35 |
| 4,270,737 | A | * | 6/1981 | Binns | E04H 17/10 256/32 |
| 4,290,712 | A | * | 9/1981 | Hayes | E01F 9/608 256/1 |
| 5,133,727 | A | * | 7/1992 | Bales | A61B 17/29 606/170 |
| 5,638,827 | A | * | 6/1997 | Palmer | A61B 10/06 600/564 |
| 6,142,956 | A | * | 11/2000 | Kortenbach | A61B 10/0266 600/564 |
| 7,341,232 | B2 | * | 3/2008 | Masas | E04B 9/006 248/342 |
| 8,540,217 | B2 | | 9/2013 | Olsson et al. | |
| 2011/0233497 | A1 | * | 9/2011 | Forge | E04H 17/10 256/47 |
| 2015/0225978 | A1 | * | 8/2015 | White | E04H 17/10 256/46 |
| 2015/0299969 | A1 | * | 10/2015 | James | E01F 15/06 256/13.1 |

* cited by examiner

WIRE RETAINING FENCE POST

TECHNICAL FIELD

The present invention relates to a wire retaining fence post.

BACKGROUND ART

The following discussion of the background art is intended to facilitate an understanding of the present invention only. The discussion is not an acknowledgement or admission that any of the material referred to is or was part of the common general knowledge as at the priority date of the application.

Wire retaining fence posts are typically limited to posts with a series of apertures provided through the post. Metal clips are employed to attach fence wire to fence posts. Once the fence wire is positioned against the post, a metal clip has one end fastened in a coil around the fence wire on one side of the post, then is drawn through the aperture of the post, and the other end of the metal clip is coiled around the fence wire on the other side of the post. This process is time consuming as it involves individual metal clips to be tied multiple times along each post, for each longitudinal wire of the fence. Additionally, the process also requires the installer to carry the load of metal clips.

Improved fence posts have replaced the clip wires with rigid clasps that are fed through the apertures and are moved to a locking position to retain the wire against the post. Whilst this design is quicker than coiling the wire, it remains time consuming and requires the installer to carry the load of rigid clasps.

Further fence post designs have attempted to reduce the time taken to attach the wire to the post and the user carrying a load of wire clasps by utilizing latching mechanisms on the post. These typically involve a channel in the side of the post which receives the wire, the latching mechanism is then engaged to retain the wire in position. Whilst the installation time is decreased, the multiple complex latching mechanisms required along the length of the post significantly increase the cost of producing the posts.

Those skilled in the art will appreciate that the invention described herein is susceptible to variations and modifications other than those specifically described. The invention includes all such variation and modifications. The invention also includes all of the steps, features, formulations and compounds referred to or indicated in the specification, individually or collectively and any and all combinations or any two or more of the steps or features.

Any manufacturer's instructions, descriptions, product specifications, and product sheets for any products mentioned herein or in any document incorporated by reference herein, are hereby incorporated herein by reference, and may be employed in the practice of the invention.

The present invention is not to be limited in scope by any of the specific embodiments described herein. These embodiments are intended for the purpose of exemplification only. Functionally equivalent products, formulations and methods are clearly within the scope of the invention as described herein.

The invention described herein may include one or more range of values (e.g. size). A range of values will be understood to include all values within the range, including the values defining the range, and values adjacent to the range which lead to the same or substantially the same outcome as the values immediately adjacent to that value which defines the boundary to the range.

Throughout this specification, unless the context requires otherwise, the word "comprise" or variations such as "comprises" or "comprising", will be understood to imply the inclusion of a stated integer or group of integers but not the exclusion of any other integer or group of integers

SUMMARY OF INVENTION

In accordance with the present invention there is provided a wire retaining fence post adapted to receive a wire fence, the wire retaining fence post comprising:

an elongate body;

at least one flange extending from the elongate body, the flange being provided with a wire receiving channel located in a distal edge of the flange, the wire receiving channel being in communication with a wire retaining cavity provided through the flange; and a gate pivotably coupled to the flange across the wire receiving channel, wherein the gate is operable in a closed configuration and an open configuration, and wherein the gate is biased towards the closed configuration.

It will be appreciated that the term pivotably coupled will be understood to encompass any coupling of the gate and the flange which allows the gate to pivot at a pivot point along the length of the gate.

It will be understood that the gate has two ends that are distal to one another. In one form of the invention the gate pivots at one of the two ends of the gate.

In one form of the present invention, the gate is directly coupled to the flange. It is envisaged that the gate is coupled to the flange without any additional retaining means, such as for example by passing through a portion of the flange.

In one form of the present invention, the gate has a pivot end and an engaging end. Preferably, the pivot end is pivotably mounted to the elongate body at a pivot region.

Preferably, the engaging end abuts an edge of the wire retaining cavity when the gate is in the closed configuration. Still preferably, the point at which the engaging end abuts the wire retaining cavity is provided with a recess shaped to receive the engaging end.

It will be appreciated that the term 'across the wire receiving channel' will be understood to encompass any configuration of the gate which will disrupt communication of the wire receiving channel and the wire retaining cavity when the gate is in the closed configuration. In this arrangement, a fence wire will not be able to pass from the wire retaining cavity to the wire receiving channel whilst the gate is in the closed configuration. Similarly, a fence wire will not be able to pass from the wire receiving channel to the wire retaining cavity whilst the gate is in the closed configuration.

Similarly, it will be appreciated that when the gate is in the open configuration, communication between the wire receiving channel and the wire retaining cavity is established. In this arrangement, a fence wire is able to pass from the wire retaining cavity to the wire receiving channel whilst the gate is in the open configuration. Similarly, a fence wire will not be able to pass from the wire receiving channel to the wire retaining cavity whilst the gate is in the closed configuration.

In one form of the present invention, the gate is constructed from a single piece of wire having two ends, provided in a looped arrangement. Preferably, the two ends of the single piece of wire essentially marry to form the gate. More preferably, the gate is constructed from a single piece of wire having two ends, in a looped arrangement such that the two ends of the gate couple to the flange at the pivot end.

In one form of the present invention, the two ends pass perpendicularly through the flange in opposite directions at two discreet points. More preferably, the two discreet points are offset from one another in a direction substantially perpendicular to the longitudinal direction of the elongate body. By providing the two points in which the two ends of the gate pass through the flange separately and in an offset manner, the gate is provided with a bias towards the closed configuration. It will be appreciated that the two discreet points may be offset from one another both in a direction substantially perpendicular and substantially parallel to the longitudinal direction of the elongate body whilst remaining biased towards the closed configuration.

In one form of the present invention the two ends of the wire are provided with a retention means, where the retention means acts to inhibit the gate from uncoupling from the flange. It is envisaged that the retention means may be integrally formed with the two ends of the wire or be provided additional thereto.

In one form of the invention, where the retention means is integral with the two ends of the wire, the retention means is provided in the form of a bend in at least one of the two ends of the wire. Preferably, where the retention means is integral with the two ends of the wire, the retention means is provided in the form of a bend in both of the two ends of the wire. More preferably, the bend is in a direction away from the direction in which the ends of the wire pass through the flange. Still preferably, the bend is in a direction 90° away from the direction in which the ends of the wire pass through the flange. Still preferably, the bend is in a direction 90° away from the direction in which the ends of the wire pass through the flange and in a direction perpendicular to the elongate body. It is envisaged that the bend makes the gate is more resilient to forces on the fence post that may dislodge the gate from the flange, whilst still allowing the gate to pivot between the open and closed positons.

In one form of the present invention, the gate is directly coupled to the flange at a slot. Preferably, the two ends of the wire pass through the slot. In this arrangement, the gate is directly coupled to flange at the slot.

In one form of the present invention, the slot extends in a direction that is perpendicular to the elongate body. In an alternative form of the present invention, the slot extends in a direction between perpendicular and parallel to the elongate body. For example the slot may extent in a direction that is 20°, 30° or 45° to the perpendicular of the elongate body.

Commercially available fence posts are typically provided with a series of pre-machined apertures along the length of at least one of the flanges. It will be appreciated that these apertures may be utilised to directly couple the gate to the flange. It is envisaged that these pre-machined apertures may also be utilised as the wire retaining cavity by the provision of the wire receiving channel from the distal edge of the flange to the pre-machined aperture.

In one form of the present invention, the two ends of the wire pass through a pre-machined aperture provided in the flange.

Preferably, the wire receiving channel is substantially perpendicular to a longitudinal axis of the elongate body.

Preferably, the wire retaining cavity is an elongate spacing extending essentially parallel to the longitudinal length of the elongate body.

In one form of the presenting invention, the wire receiving channel and the wire retaining cavity essentially form an "L" shape.

Preferably, the width of each wire receiving channel is greater than the diameter of the wire. It is envisaged that by having the width of the channel greater than that of the wire, it allows the wire to pass through the wire receiving channel with relative ease.

Preferably, the width of the wire retaining cavity is greater than the width of the wire receiving channel. By providing the wire retaining cavity at a width greater than the width of the wire receiving channel, it is envisaged that the wire will easily transition from the wire receiving channel to a retained position within the wire retaining cavity.

Preferably, the length of the wire retaining cavity is at least twice the width of the wire receiving channel. Still preferably, the length of the wire retaining cavity is at least three times the width of the wire receiving channel.

The wire retaining cavities may be spaced to accommodate known fence spacings employed by various manufacturers. In one form of the present invention, the wire receiving channels and respective wire retaining cavities are spaced equally along the length of the wire retaining fence post, for example at 50 mm intervals.

BRIEF DESCRIPTION OF THE DRAWINGS

Further features of the present invention are more fully described in the following description of five non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENTS

Figure 1:
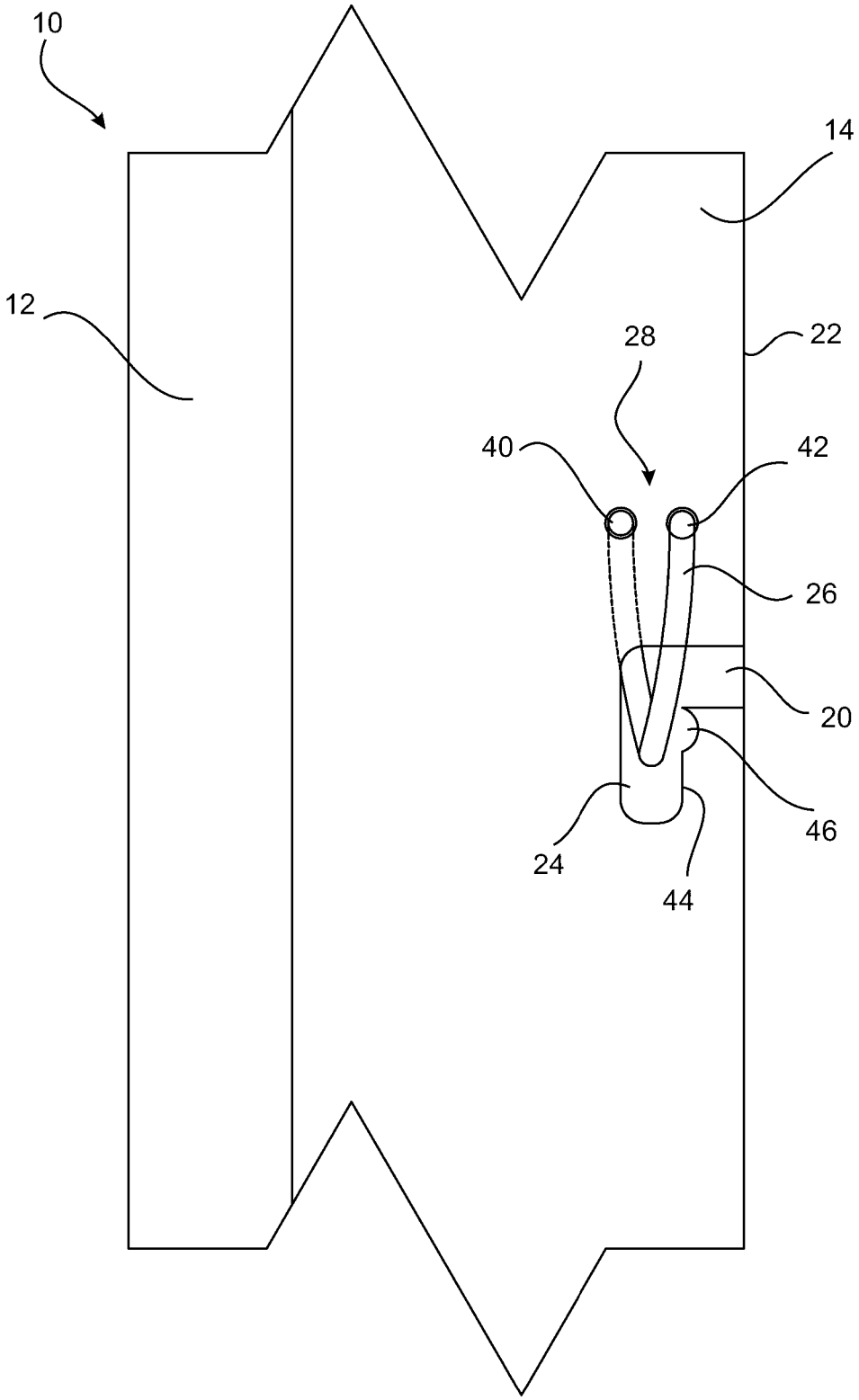
FIG. 1 is a side elevation of the wire retaining fence post of a first embodiment of the present invention.
Figure 2:
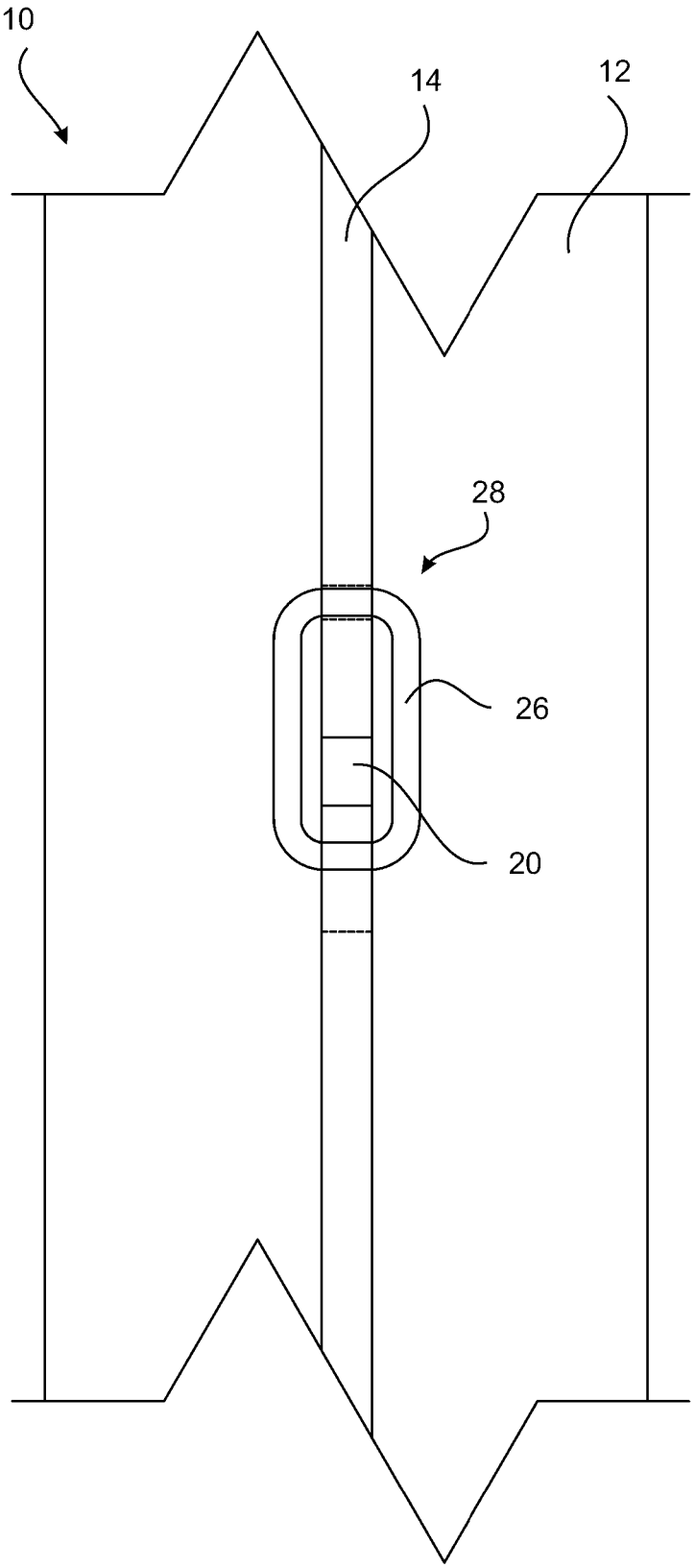
FIG. 2 is a frontal view of the wire retaining fence post of the first embodiment of the present invention.

In FIGS. 1, 2, 4, 5 and 6 there is shown a wire retaining fence post 10 in accordance with a first embodiment of the present invention. The wire retaining fence post 10 comprises an elongate body 12, with three flanges 14 (two of the flanges not shown) extending therefrom. The flange 14 is provided with a series of wire receiving channels 20 (one shown) along its longitudinal length. Each wire receiving channel 20 extends from an outer edge 22 of the flange 14 in a direction substantially perpendicular to the longitudinal axis of the flange 14 and communicates with a corresponding wire retaining cavity 24 provided through the flange 14. The wire retaining cavity 24 extends substantially parallel to the longitudinal axis of the elongate body 12. As can be seen in FIG. 1, the wire receiving channel 20 and the wire retaining cavity 24 communicate to form an "L" shape.

Figure 4:
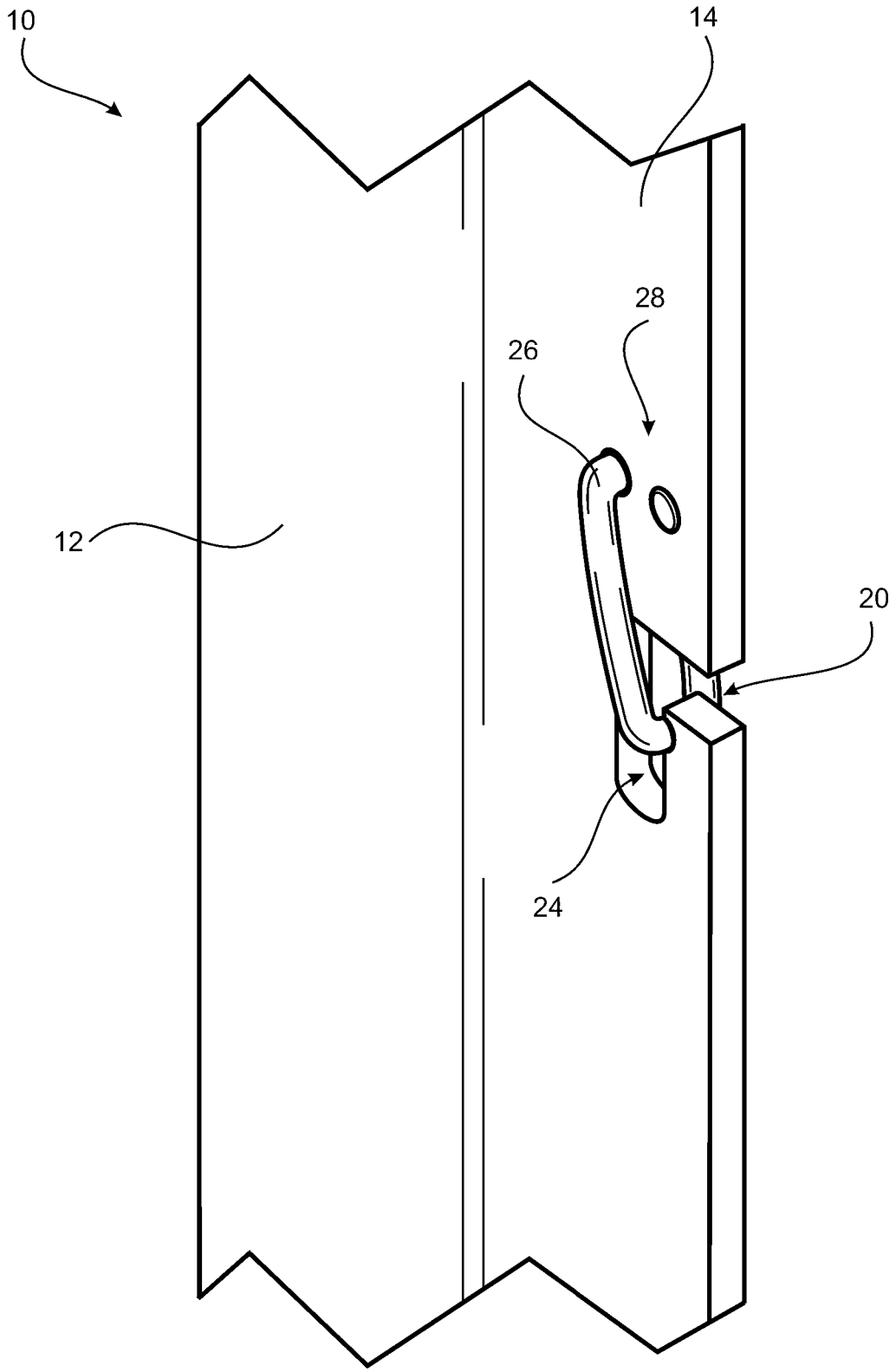
FIG. 4 is a perspective view of the wire retaining fence post of the first embodiment of the present invention.
Figure 5:
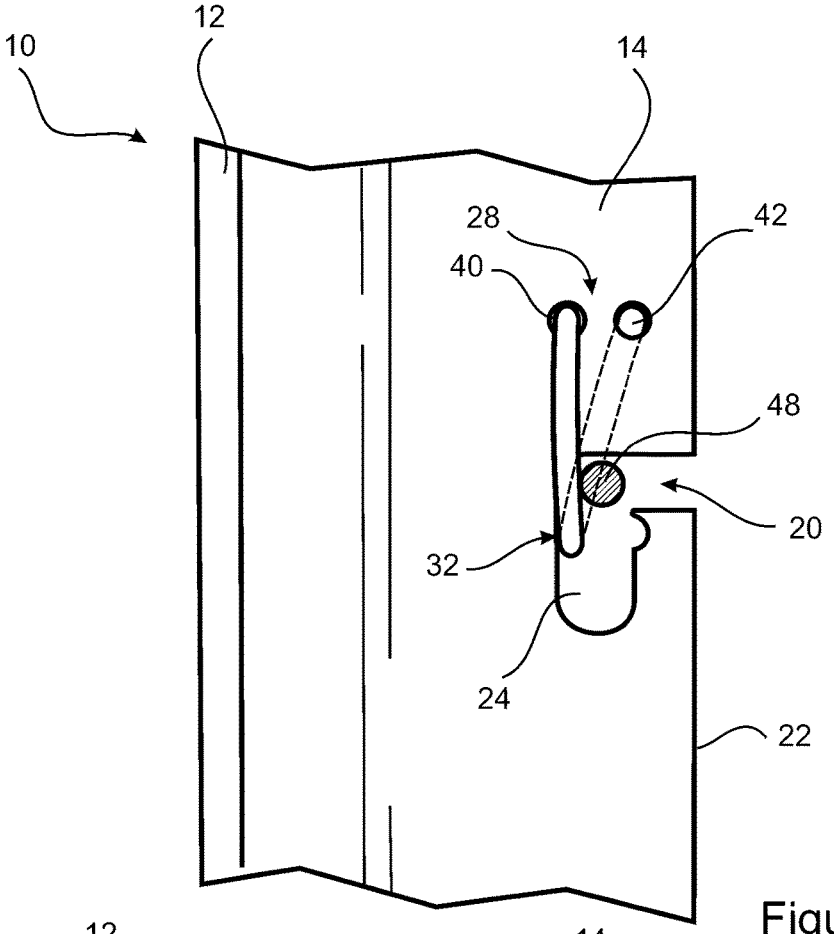
FIG. 5 is a side elevation of the wire retaining fence post of FIG. 4 showing a wire fence being installed in the wire retaining fence post.
Figure 6:
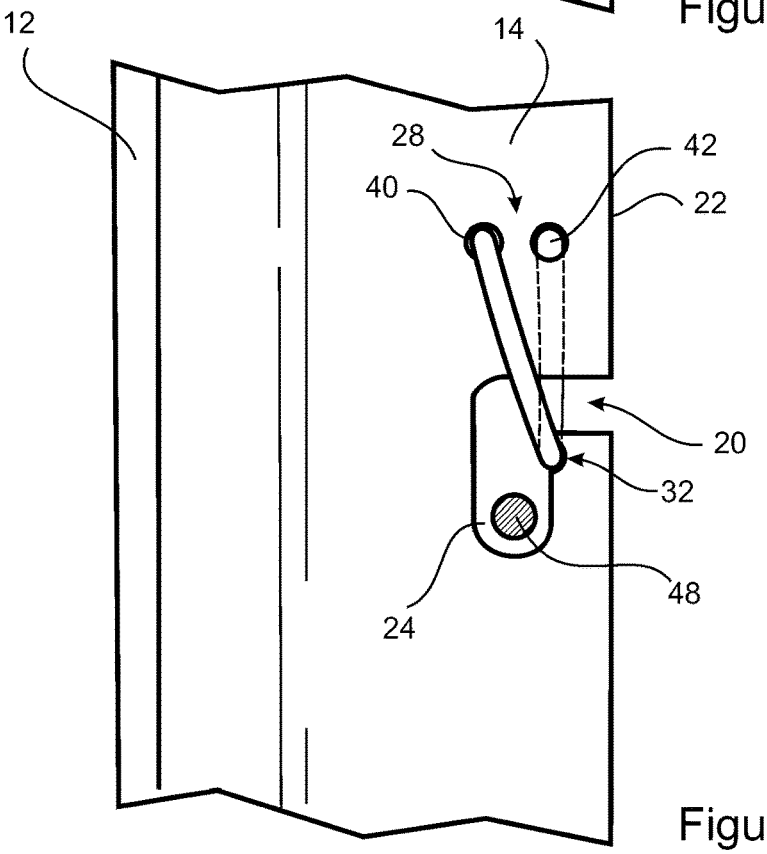
FIG. 6 is a side elevation of the wire retaining fence of FIG. 4, showing the wire fence retained within the wire retaining fence post.

The fence post 10 further comprises a purity of gates 26 (one shown). Each gate 26 is pivotably coupled to the flange 14 across the wire receiving channel 20 at a pivot region 28. The gate 26 is operable between an open and closed position. The gate 26 prevents communication of the wire receiving channel 20 and the wire retaining cavity 24 in a closed configuration. The gate 26 may pivot about the pivot region 28 forming an open wire receiving channel 20 in an open configuration, as shown in FIGS. 1 and 5. The gate 26 is biased towards the closed configuration, as shown in FIGS. 4 and 6.

Figure 3:
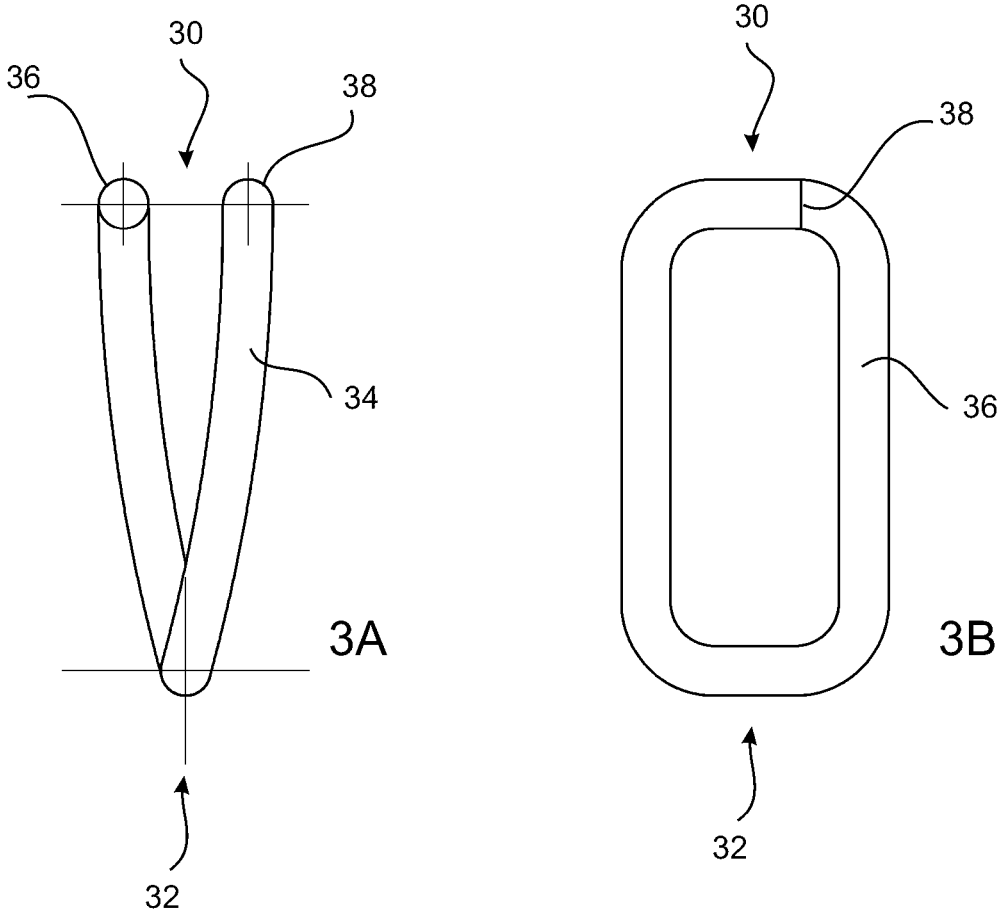
FIGS. 3*a* and 3*b* show side elevation and frontal views of the gate of the wire retaining fence post of the first embodiment of the present invention respectively.

As best seen in FIGS. 3*a* and 3*b*, the gate 26 has a pivot end 30 and an engaging end 32. The gate 26 is constructed from a single piece of wire 34 having two ends 36, 38, in a looped arrangement such that the two ends 36, 38 essentially marry at the pivot region 28 to form the gate 26. The cross section of the wire of the gate 26 is typically between 1 mm and 3 mm. When looped, the length of the gate 26 is approximately 15 mm.

As shown in FIGS. 1, 2, 4, 5 and 6, the pivot end 30 is pivotably mounted to the elongate body 12 at the pivot region 28. The two ends 36, 38 pass perpendicularly through the flange 14 in opposite directions at two discreet points 40, 42 respectively. The two discreet points 40, 42 are offset from one another in a direction substantially perpendicular to the longitudinal direction of the elongate body 12. The two discreet points 40, 42 are positioned about 4 mm apart. By providing the two points 40, 42 in which the two ends 36, 38 of the gate 26 pass through the flange separately and in an offset manner, the gate 26 is provided with a bias towards the closed configuration.

In the embodiment shown in FIGS. 1, 2, 4, 5 and 6 the two points 40, 42 are positioned approximately between 7 mm and 9 mm from the wire receiving channel 20 in the longitudinal direction of the elongate body 12.

As shown in in FIG. 4, when in the closed configuration, the engaging end 32 abuts an edge 44 of the wire retaining cavity 24 The point at which the engaging end 32 abuts the outer edge 44 wire retaining cavity 24 is provided with a recess 46 shaped to receive the engaging end 32. Importantly, the inventors have discovered that by proving the two ends of the wire in an offset manner in a direction substantially perpendicular to the longitudinal direction of the elongate body 12, the bias of the gate causes the engaging end 32 to exert a force on the outer edge 44 wire retaining cavity 24. This demonstrates that the bias of the gate 26 in this arrangement is stronger than an arrangement which simply returns the gate to a neutral position. This is particularly advantageous as the fence wire is much less likely to be inadvertently dislodged from the fence post.

The width of each wire receiving channel 20 is between 1.5 and 4 mm greater than the diameter of the fence wire. Having the width of the wire receiving channel 20 greater than of the diameter of the wire allows the wire to pass through the wire receiving channel 20 with relative ease. For most commercial applications, the diameter of the wire receiving channel is between 1.5 mm and 3 mm greater than the diameter of the wire fence.

The width of the wire retaining cavity 24 is greater than the width of the wire receiving channel 20. By providing the wire retaining cavity 24 at a greater width than the width of the wire receiving channel 20, it is envisaged that the wire will easily transition from the wire receiving channel 20 to the wire retaining cavity 24. The difference the diameter of the wire retaining cavity 24 and the width of the wire receiving channel 20 will also assist in retaining the wire fence in the wire retaining cavity.

The length of the wire retaining cavity 24 is at least three times the width of the wire receiving channel 20. In typical applications the length of the wire retaining cavity 24 is between 10 mm and 13 mm.

The wire receiving channels 20 and respective wire retaining cavities 24 are spaced equally along the length of the wire retaining fence post 10, for example at 50 mm intervals.

In use, an installer (not shown) will install the fence post into the ground in an upright position. The fence wire is strung perpendicular to the post between multiple wire retaining fence posts. As best seen in FIG. 5, the particular arrangement of the present invention allows for a fence wire 48 to be manually forced through the wire receiving channel 20, forcing the gate 26 into an open position so that the fence wire may pass to the wire retaining cavity 24. At seen in FIG. 6, once the fence wire is positioned within the wire retaining cavity 24, the bias of the gate 26 will return it to a closed position, thereby securing the wire fence within the wire retaining cavity 24.

Figure 7:
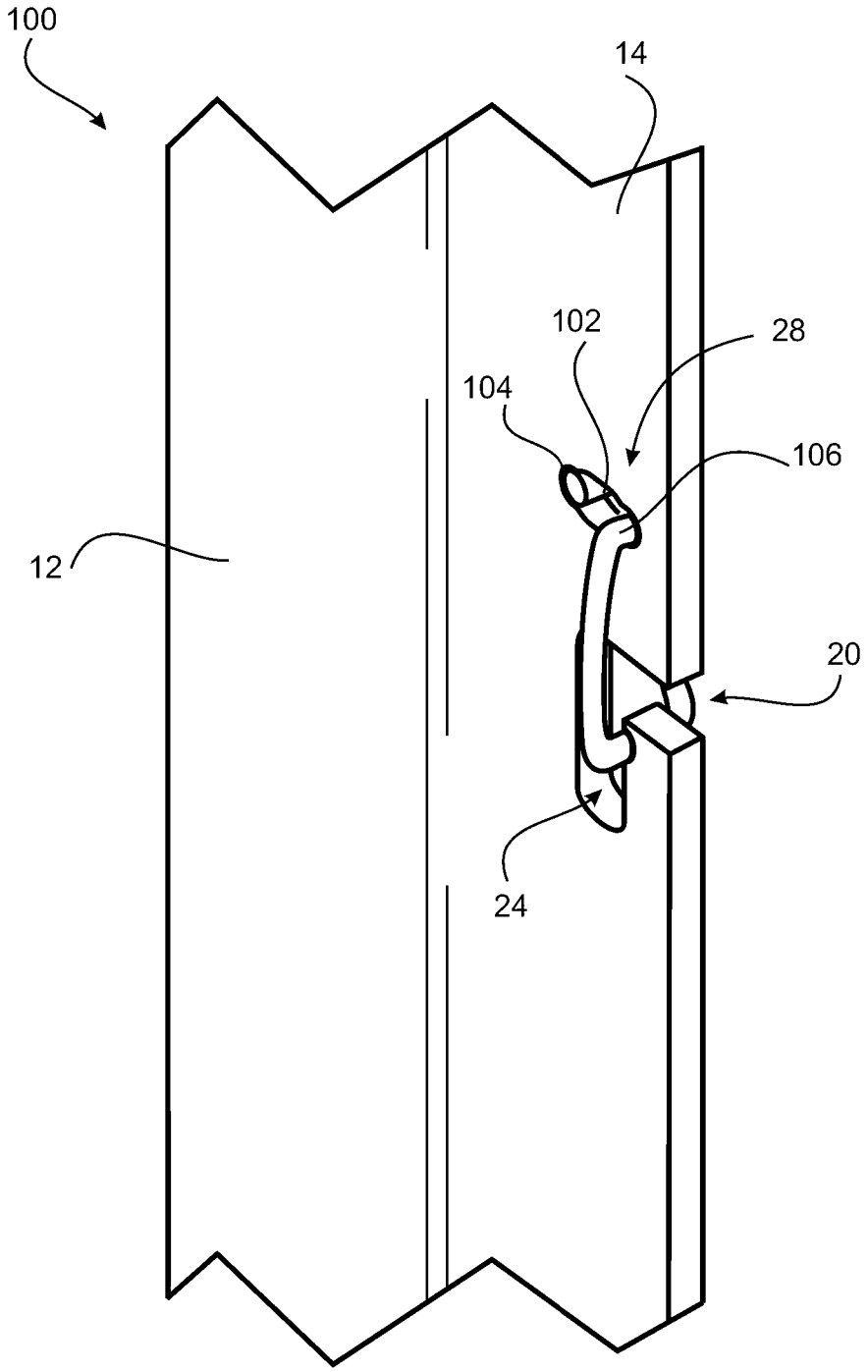
FIG. 7 is a perspective view of the wire retaining fence post of a second embodiment of the present invention.
Figure 8:
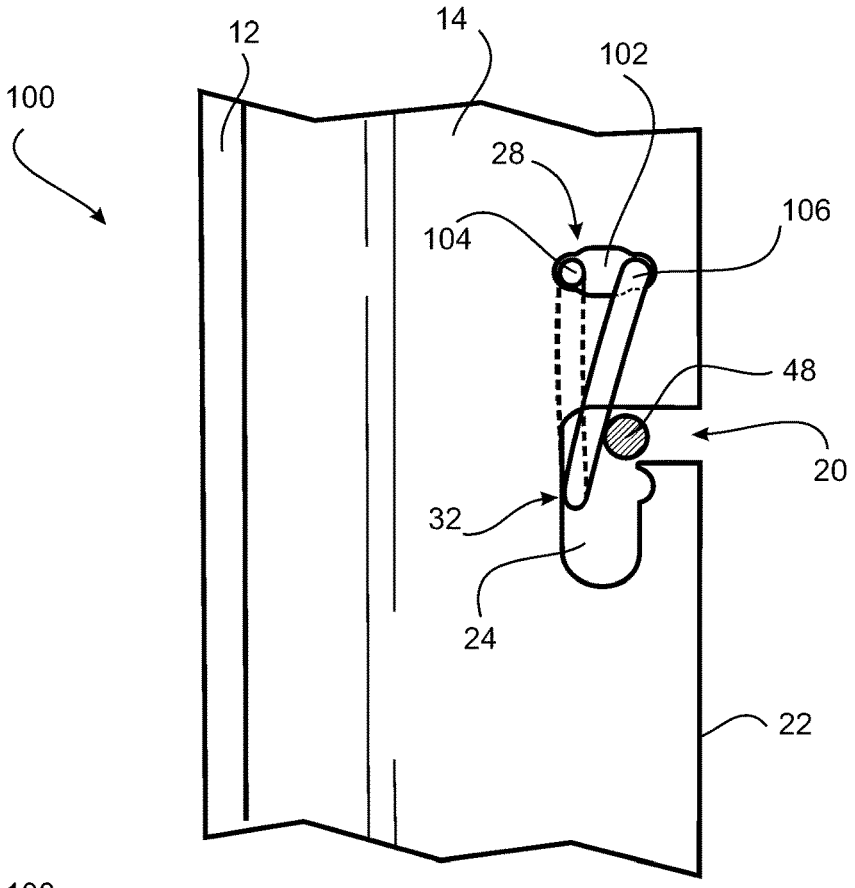
FIG. 8 is a side elevation of the wire retaining fence post of FIG. 7 showing a wire fence being installed in the wire retaining fence post.
Figure 9:
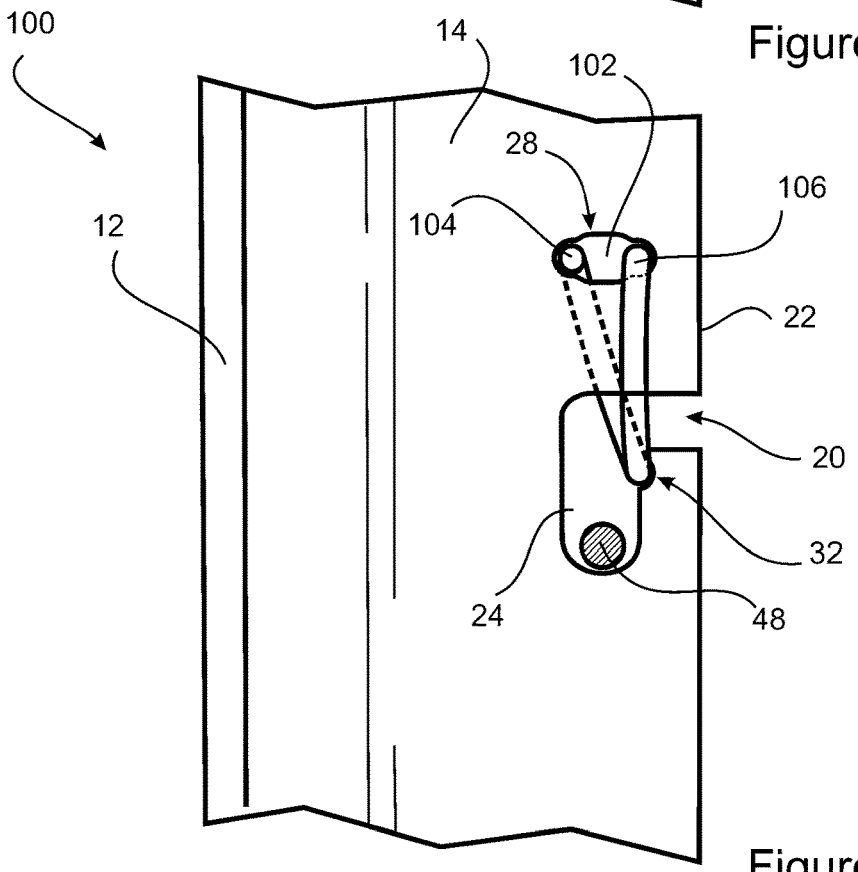
FIG. 9 is a side elevation of the wire retaining fence of FIG. 7, showing the wire fence retained within the wire retaining fence post.

In FIGS. 7 to 9 there is shown a wire retaining fence post 100 in accordance with a second embodiment of the present invention. In as much as the wire retaining fence 100 shares certain features of wire retaining fence 10, like numerals denote like parts.

The wire retaining fence post 100 comprises an elongate body 12, with three flanges 14 (two of the flanges not shown) extending therefrom. The flange 14 is provided with a series of wire receiving channels 20 along its longitudinal length. Each wire receiving channel 20 extends perpendicularly to the longitudinal axis of the flange 14 from an outer edge 22 of the flange 14 and communicates with a corresponding wire retaining cavity 24 provided through the flange 14. The wire retaining cavity 24 extends parallel to the longitudinal axis of the flange 14. As can be seen in FIGS. 8 and 9, the wire receiving channel 20 and the wire retaining cavity 24 communicate to form an "L" shape.

Each wire receiving channel 20 further comprises a gate 26. Each gate 26 is pivotably coupled at a pivot region 28 to the flange 14 across the wire receiving channel 20. The gate 26 forms a closed wire receiving channel 20 in a closed configuration. The gate 26 may pivotably rotate about the pivot region 28 forming an open wire receiving channel 20 in an open configuration, as shown in FIG. 8. The gate 26 is biased towards the closed position, best shown in FIGS. 7 and 9.

Similarly to what is shown in FIGS. 3*a* and 3*b*, the gate 26 has a pivot end 30 and an engaging end 32. The gate 26 is constructed from a single piece of wire 34 having two ends 36, 38, in a looped arrangement such that the two ends 36, 38 essentially marry at the pivot region 28 to form the gate 26.

The pivot end 30 is pivotably mounted to the flange 14 at the pivot region 28. A slot 102 is provided through the flange 14. The slot 102 extends perpendicular to the longitudinal axis of the flange 14. The two ends 36, 38 pass perpendicularly through the slot 102 in opposite directions.

The gate 26 is looped such that under no load, the ends 36, 38 are offset from one another by a distance greater than the length of the slot 102. In this arrangement, the ends 36, 38 must be manually manipulated toward each other in order to both pass through the slot 102. Once in the slot 102 and the manual manipulation is removed, the tensile strength and bias of the wire will force the ends 36, 38 apart to two discreet points 104, 106 respectively. The two discreet points 104, 106 are offset from one another in a direction substantially perpendicular to the longitudinal direction of the elongate body 12. By providing the two points 104, 106 in which the two ends 36, 38 of the gate 26 pass through the flange 14 separately and in an offset manner, the gate 26 is provided with a bias towards the closed configuration.

The engaging end 32 abuts an outer edge 44 of the wire retaining cavity 24 when in the closed configuration. The point at which the engaging end 32 abuts the outer edge 44 wire retaining cavity 24 is provided with a slot 46 shaped to receive the engaging end 32.

The width of each wire receiving channel 20 is between 1.5 and 4 mm greater than the diameter of the fence wire. Having the width of the wire receiving channel 20 greater than of the diameter of the wire, allows the wire to pass through the wire receiving channel 20 with relative ease.

The width of the wire retaining cavity 24 is greater than the width of the wire receiving channel 20. By providing the wire retaining cavity 24 at a greater width than the width of the wire receiving channel 20, it is envisaged that the wire will easily transition from the wire receiving channel 20 to the wire retaining cavity 24. The difference the diameter of the wire retaining cavity 24 and the width of the wire receiving channel 20 will also assist in retaining the wire fence in the wire retaining cavity.

The length of the wire retaining cavity 24 is at least three times the width of the wire receiving channel 20.

The wire receiving channels 20 and respective wire retaining cavities 24 are spaced equally along the length of the wire retaining fence post 10, for example at 50 mm intervals.

In use, an installer (not shown) will install the fence post into the ground in an upright position. The fence wire is strung perpendicular to the post between multiple wire retaining fence posts. As best seen in FIG. 8, the particular arrangement of the present invention allows for a fence wire 48 to be manually forced through the wire receiving channel 20, forcing the gate 26 into an open position so that the fence wire may pass to the wire retaining cavity 24. At seen in FIG. 9, once the fence wire is positioned within the wire retaining cavity 24, the bias of the gate 26 will return it to a closed position, thereby securing the wire fence within the wire retaining cavity 24.

Figure 10:
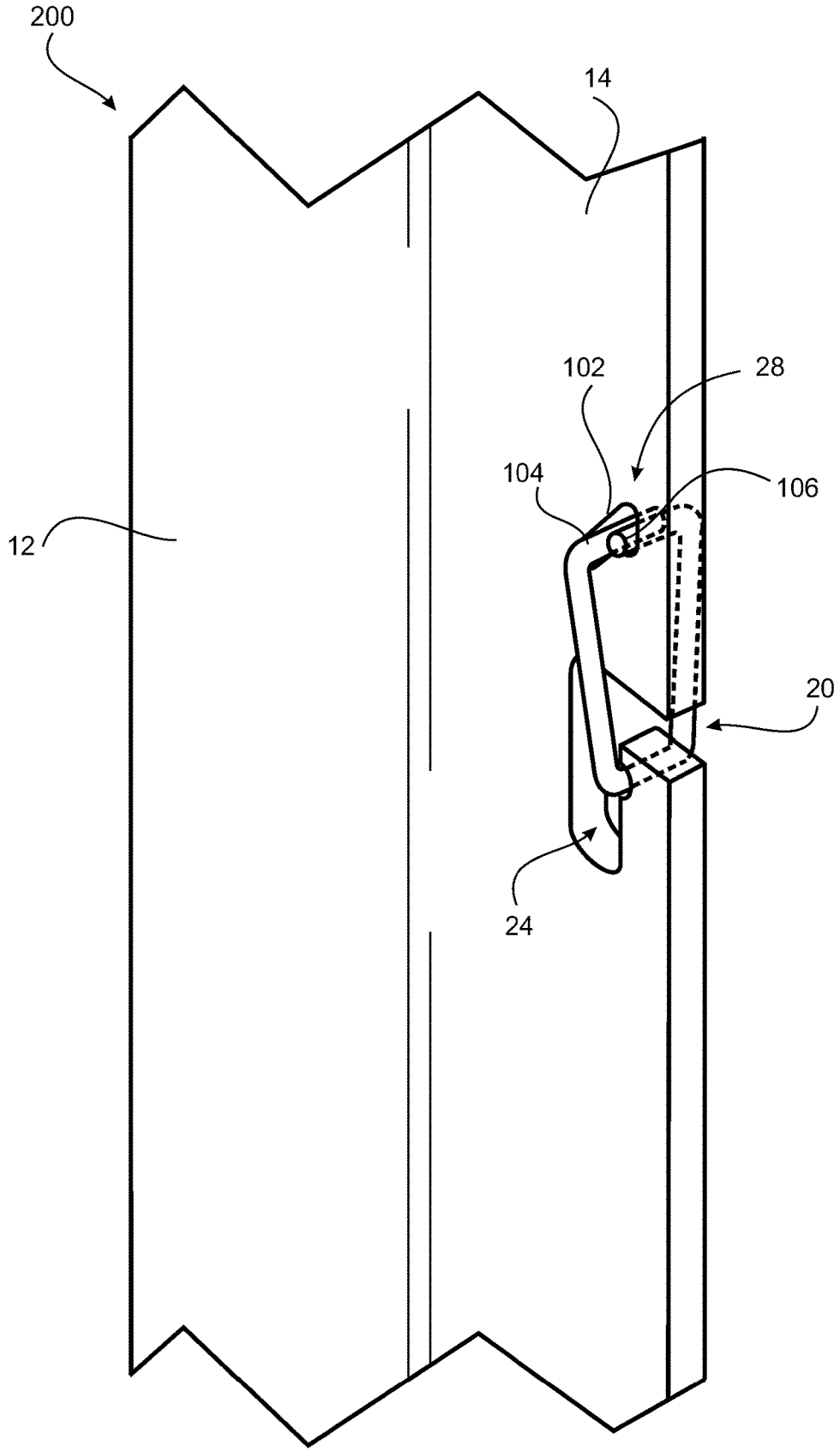
FIG. 10 is a perspective view of the wire retaining fence post of a third embodiment of the present invention.
Figure 11:
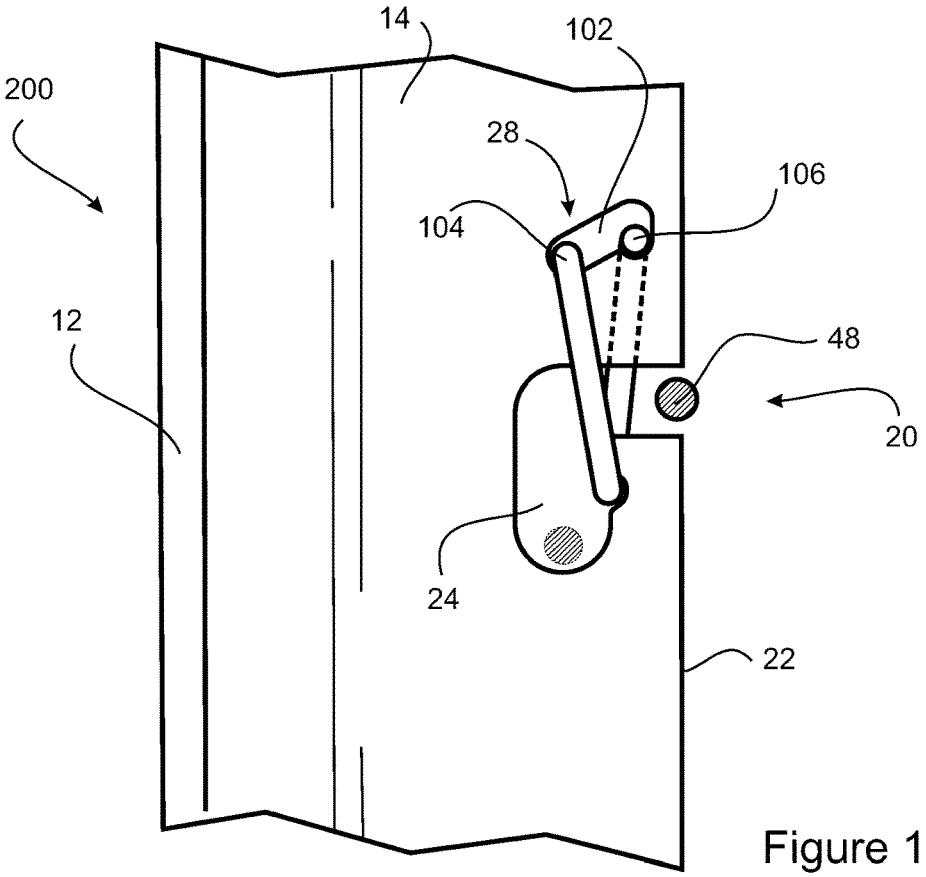
FIG. 11 is a side elevation of the wire retaining fence post of FIG. 10 showing a wire fence being installed in the wire retaining fence post.
Figure 12:
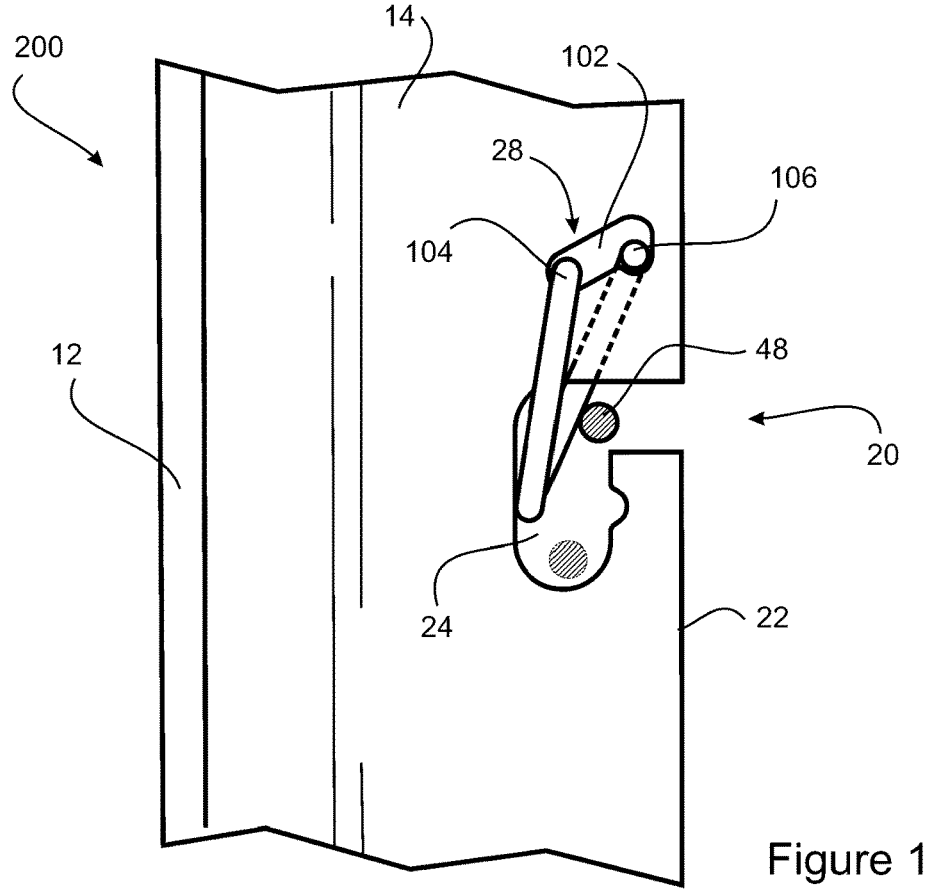
FIG. 12 is a side elevation of the wire retaining fence of FIG. 10, showing the wire fence retained within the wire retaining fence post.

In FIGS. 10 to 12 there is shown a wire retaining fence post 200 in accordance with a third embodiment of the present invention. In as much as the wire retaining fence 200 shares certain features of wire retaining fence 10 and 100, like numerals denote like parts.

Similarly to what is shown in FIGS. 7 to 9, a slot 102 is provided through the flange 14. However, the direction of the slot 102 is at an angle between parallel and perpendicular to the longitudinal axis of the flange 14. Similarly to FIGS. 7 to 9 the two ends 36, 38 pass perpendicularly through the slot 102 in opposite directions. Due to the arrangement of the slot 102, the two end 36, 38 are offset from one another in both a direction perpendicular to the flange and a direction that is parallel to the flange. It is understood by the applicant that the provision of the of slot 102 in this direction assists to maintain the coupling of the gate to the flange.

Figure 13:
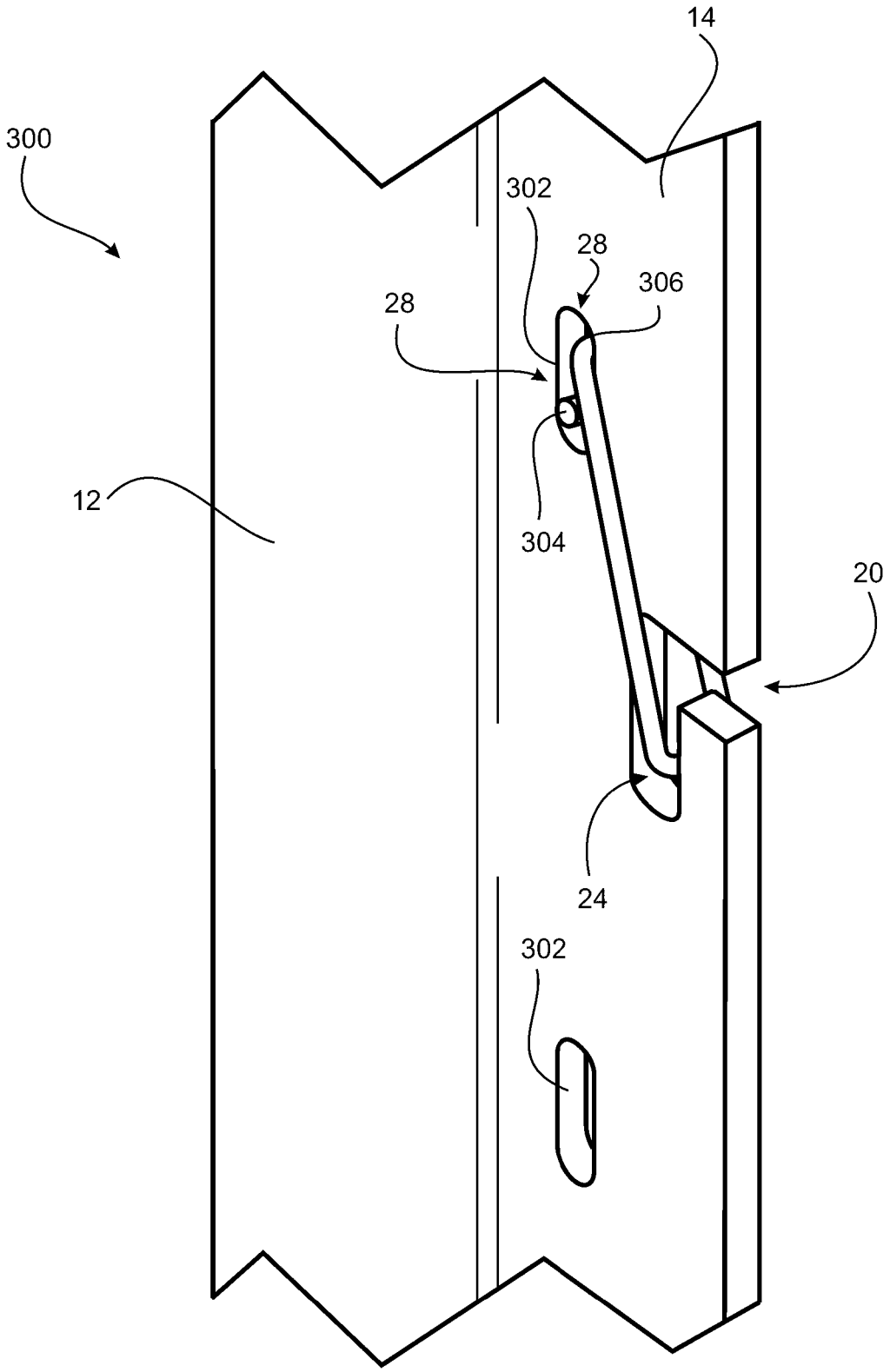
FIG. 13 is a perspective view of the wire retaining fence post of a fourth embodiment of the present invention.
Figure 14:
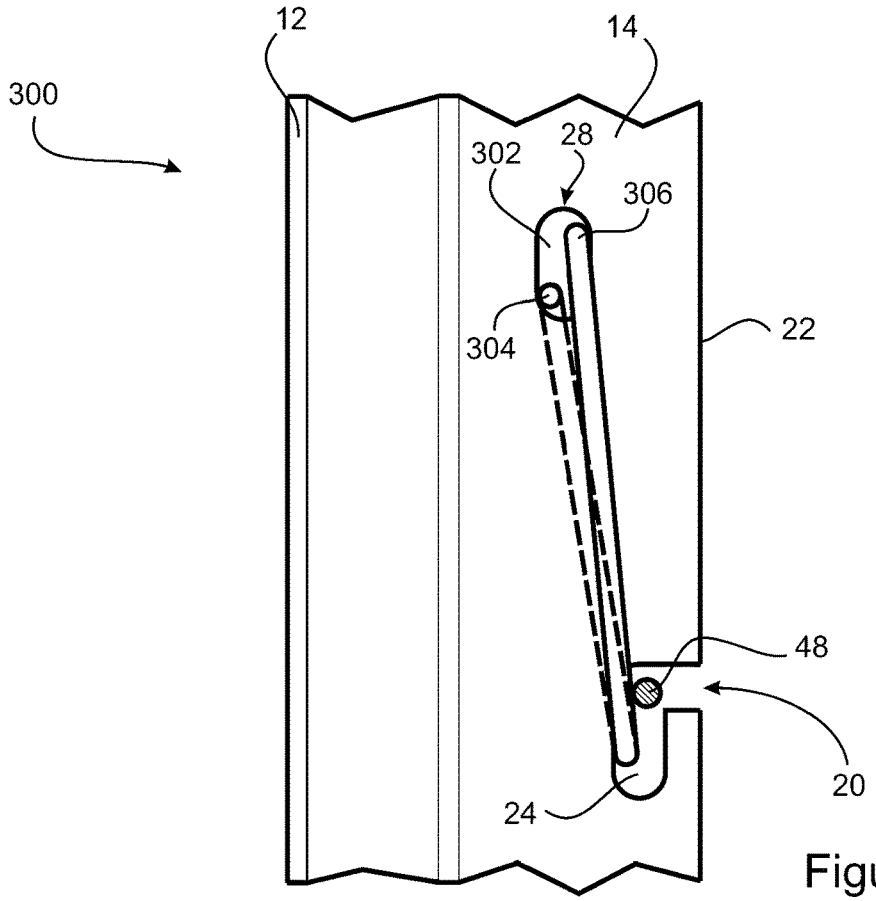
FIG. 14 is a side elevation of the wire retaining fence post of FIG. 13 showing a wire fence being installed in the wire retaining fence post.
Figure 15:
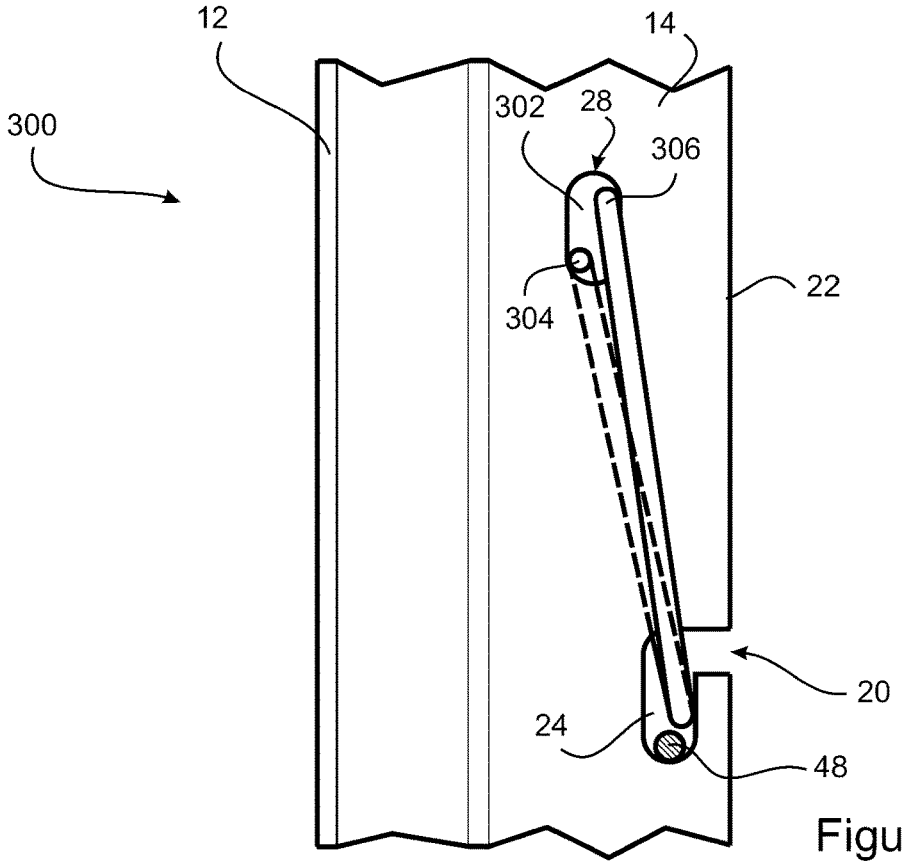
FIG. 15 is a side elevation of the wire retaining fence of FIG. 13, showing the wire fence retained within the wire retaining fence post.

In FIGS. 13 to 15 there is shown a wire retaining fence post 300 in accordance with a fourth embodiment of the present invention. In as much as the wire retaining fence 300 shares certain features of wire retaining fence 10, 100 and 200, like numerals denote like parts.

The wire retaining fence post 300 comprises an elongate body 12, with three flanges 14 (two of the flanges not shown) extending therefrom. As shown in FIG. 13, the flange is provided with a series of pre-machined apertures 302 along its length. The flange 14 is provided with a series of wire receiving channels 20 along its longitudinal length. Each wire receiving channel 20 extends perpendicular to the longitudinal axis of the flange 14 from an outer edge 22 of the flange 14 and communicates with a corresponding wire retaining cavity 24 provided through the flange 14. The wire retaining cavity 24 extends parallel to the longitudinal axis of the flange 14. As can be seen in FIGS. 14 and 15, the wire receiving channel 20 and the wire retaining cavity 24 communicate to form an "L" shape.

Each wire receiving channel 20 further comprises a gate 26. Each gate 26 is pivotably coupled at a pivot region 28 to the flange 14 across the wire receiving channel 20. The gate 26 forms a closed wire receiving channel 20 in a closed configuration. The gate 26 may pivotably rotate about the pivot region 28 forming an open wire receiving channel 20 in an open configuration, as shown in FIG. 14. The gate 26 is biased towards the closed position, as best shown in FIGS. 13 and 15.

Similarly to what is shown in FIGS. 3*a* and 3*b*, the gate 26 has a pivot end 30 and an engaging end 32. The gate 26 is constructed from a single piece of wire 34 having two ends 36, 38, in a looped arrangement such that the two ends 36, 38 essentially marry at the pivot region 28 to form the gate 26. The cross section of the wire of the gate is typically between 1 mm and 3 mm. When looped, the length of the gate is approximately 15 mm.

The pivot end 30 is pivotably mounted to the flange 14 at a machined aperture 302. The two ends 36, 38 pass perpendicularly through the machined aperture 302 in opposite directions.

The gate 26 is looped such that under no load, the ends 36, 38 are offset from one another by a distance greater than the width of the machined aperture 302. In this arrangement, the ends 36, 38 must be manually manipulated toward each other in order to both pass through the machined aperture 302. Once in the machined aperture 302 and the manual manipulation is removed, the tensile strength of the wire will force the ends 36, 38 to two discreet points 304, 306 respectively. The two discreet points 304, 306 are positioned offset from one another in a direction substantially perpendicular to the longitudinal direction of the elongate body 12. The two discreet points 304, 306 are also positioned offset from one another in a direction parallel to the longitudinal direction of the elongate body 12. By providing the two points 304, 306 in which the two ends 36, 38 of the gate 26 pass through the flange separately and in an offset manner, the gate 26 is provided with a bias towards the closed configuration.

The engaging end 32 abuts an outer edge 44 of the wire retaining cavity 24 when in the closed configuration. The point at which the engaging end 32 abuts the outer edge 44 wire retaining cavity 24 is provided with a slot 46 shaped to receive the engaging end 32.

The width of each wire receiving channel 20 is between 1.5 and 4 mm greater than the diameter of the fence wire. Having the width of the wire receiving channel 20 greater than of the diameter of the wire, allows the wire to pass through the wire receiving channel 20 with relative ease The width of the wire retaining cavity 24 is greater than the width of the wire receiving channel 20. By providing the wire retaining cavity 24 at a greater width than the width of the wire receiving channel 20, it is envisaged that the wire will easily transition from the wire receiving channel 20 to the wire retaining cavity 24. The difference the diameter of the wire retaining cavity 24 and the width of the wire receiving channel 20 will also assist in retaining the wire fence in the wire retaining cavity.

The length of the wire retaining cavity 24 is at least three times the width of the wire receiving channel 20.

The wire receiving channels 20 and respective wire retaining cavities 24 are spaced equally along the length of the wire retaining fence post 10, for example at 50 mm intervals.

In use, an installer (not shown) will install the fence post into the ground in an upright position. The fence wire is strung perpendicular to the post between multiple wire retaining fence posts. As best seen in FIG. 11, the particular arrangement of the present invention allows for a fence wire 48 to be manually forced through the wire receiving channel 20, forcing the gate 26 into an open position so that the fence wire may pass to the wire retaining cavity 24. At seen in FIG. 12, once the fence wire is positioned within the wire retaining cavity 24, the bias of the gate 26 will return it to a closed position, thereby securing the wire fence within the wire retaining cavity 24.

Figure 16:
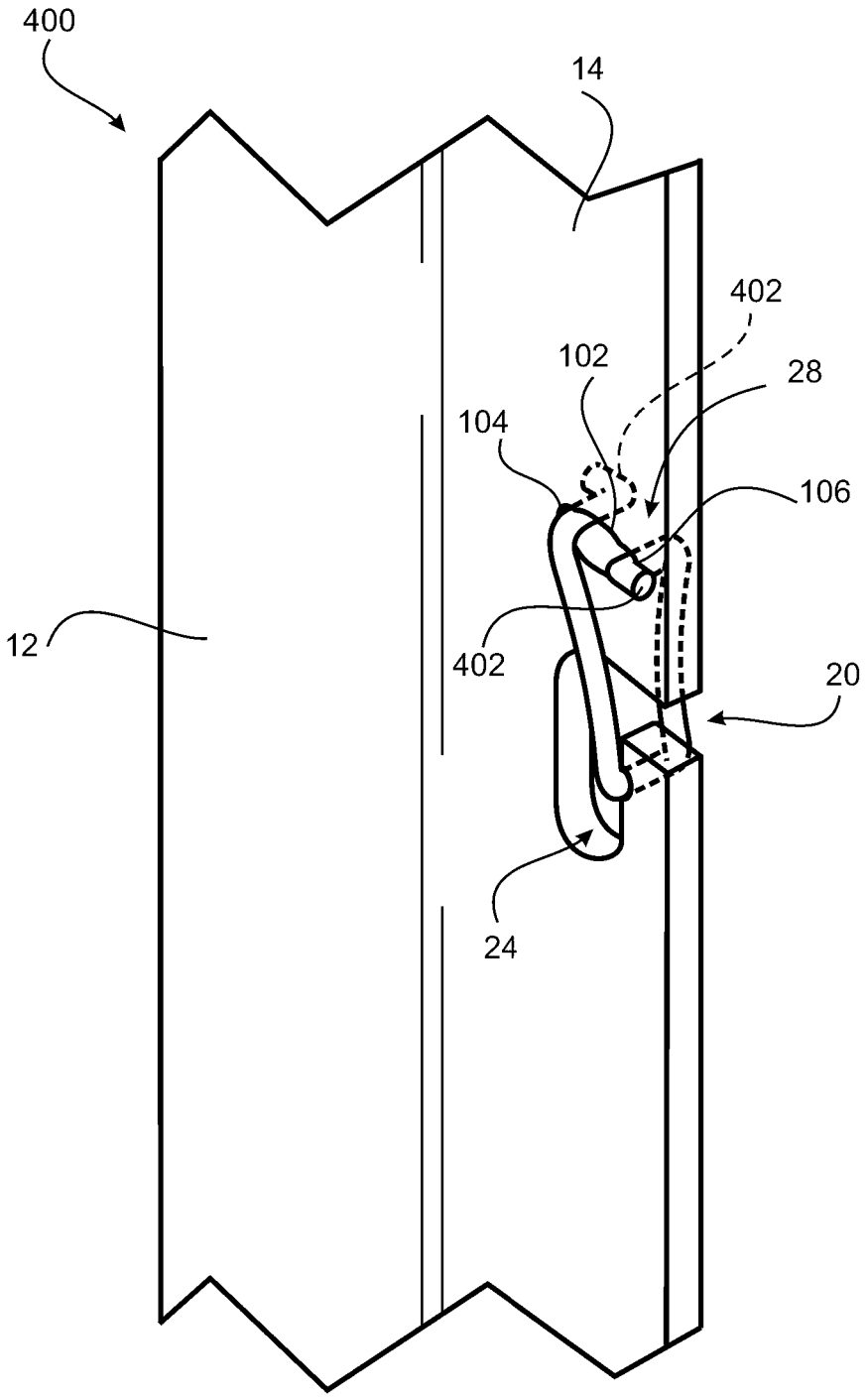
FIG. 16 is a perspective view of the wire retaining fence post of a fifth embodiment of the present invention.
Figure 17:
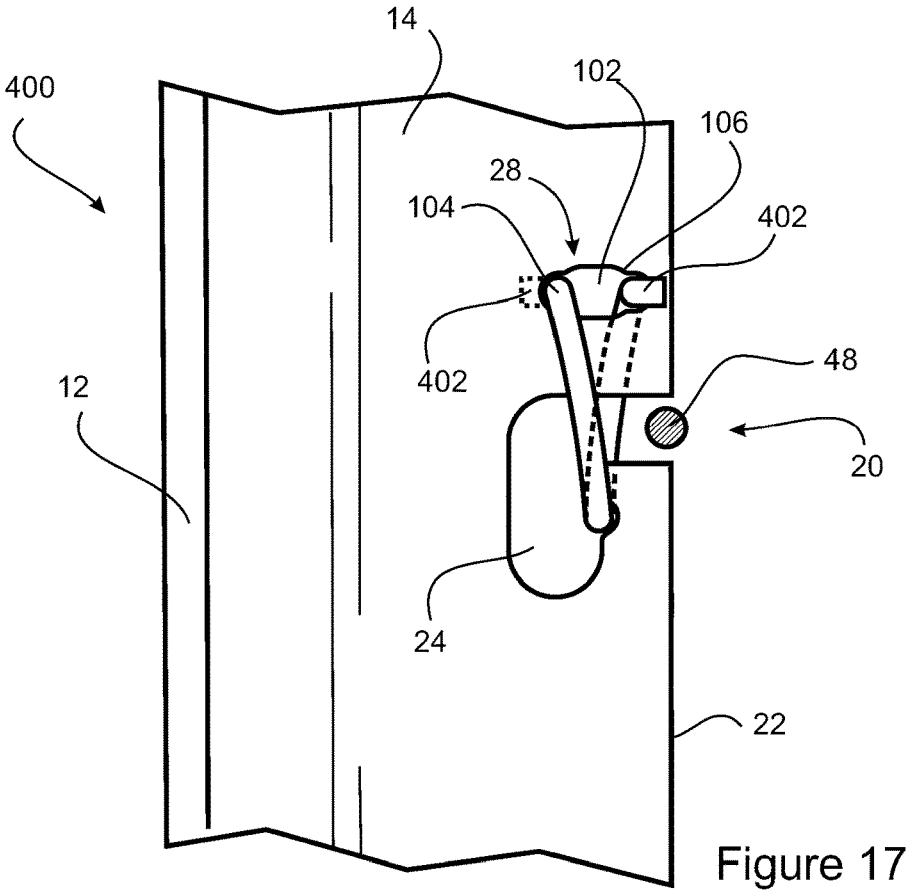
FIG. 17 is a side elevation of the wire retaining fence post of FIG. 16, showing a wire fence being installed in the wire retaining fence post.
Figure 18:
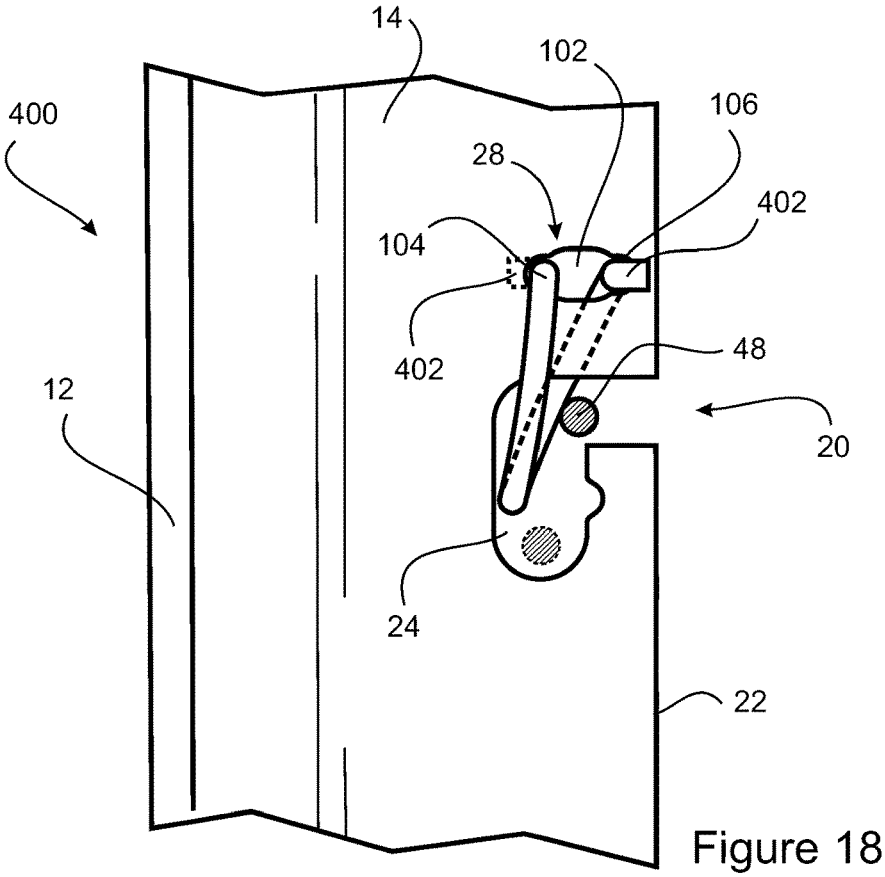
FIG. 18 is a side elevation of the wire retaining fence of FIG. 16, showing the wire fence retained within the wire retaining fence post.

In FIGS. 16 to 18 there is shown a wire retaining fence post 400 in accordance with a fifth embodiment of the present invention. In as much as the wire retaining fence 400 shares certain features of wire retaining fence 10, 100, 200 and 300, like numerals denote like parts.

The wire retaining fence post 400 comprises an elongate body 12, with three flanges 14 (two of the flanges not shown) extending therefrom. The flange 14 is provided with a series of wire receiving channels 20 along its longitudinal length. Each wire receiving channel 20 extends perpendicularly to the longitudinal axis of the flange 14 from an outer edge 22 of the flange 14 and communicates with a corresponding wire retaining cavity 24 provided through the flange 14. The wire retaining cavity 24 extends parallel to the longitudinal axis of the flange 14. As can be seen in FIGS. 17 and 18, the wire receiving channel 20 and the wire retaining cavity 24 communicate to form an "L" shape.

Each wire receiving channel 20 further comprises a gate 26. Each gate 26 is pivotably coupled at a pivot region 28 to the flange 14 across the wire receiving channel 20. The gate 26 forms a closed wire receiving channel 20 in a closed configuration. The gate 26 may pivotably rotate about the pivot region 28 forming an open wire receiving channel 20 in an open configuration, as shown in FIG. 17. The gate 26 is biased towards the closed position, best shown in FIGS. 16 and 18.

Similarly to what is shown in FIGS. 3*a* and 3*b*, the gate 26 has a pivot end 30 and an engaging end 32. The gate 26 is constructed from a single piece of wire 34 having two ends 36, 38, in a looped arrangement such that the two ends 36, 38 essentially marry at the pivot region 28 to form the gate 26.

The pivot end 30 is pivotably mounted to the flange 14 at the pivot region 28. Similarly to FIGS. 7 to 9, a slot 102 is provided through the flange 14. The slot 102 extends perpendicular to the longitudinal axis of the flange 14. The two ends 36, 38 pass perpendicularly through the slot 102 in opposite directions.

The gate 26 is looped such that under no load, the ends 36, 38 are offset from one another by a distance greater than the length of the slot 102. In this arrangement, the ends 36, 38 must be manually manipulated toward each other in order to both pass through the slot 102. Once in the slot 102 and the manual manipulation is removed, the tensile strength and bias of the wire will force the ends 36, 38 apart to two discreet points 104, 106 respectively. The two discreet points 104, 106 are offset from one another in a direction substantially perpendicular to the longitudinal direction of the elongate body 12. By providing the two points 104, 106 in which the two ends 36, 38 of the gate 26 pass through the flange 14 separately and in an offset manner, the gate 26 is provided with a bias towards the closed configuration.

The two ends 36, 38 are provided with a retention means 402 which inhibits the gate 26 from uncoupling from the flange 14. In the arrangement shown in FIGS. 16 to 18, the two ends 36, 38 bend in direction 90° away from the direction in which the two ends 36, 38 pass through the flange 14 and in a direction perpendicular to the elongate body 12 to form the retention means 402. In the embodiment shown in FIGS. 16 to 18, the slot 102 allows for the two ends 36, 38 to be bent prior to being coupled to the flange 14. In this arrangement, the retention means 402 must be manually manipulated toward each other in order to both pass through the slot 102. Once in the slot 102 and the manual manipulation is removed, the tensile strength and bias of the wire will force the retention means apart to two discreet points 104, 106 respectively.

It is envisaged however that the gate 26 may be coupled to the flange 14 prior to the two ends 36, 38 being shaped. Whist the embodiment shown in FIGS. 16 to 18 shows the retention means 402 and a slot 102 with a direction substantially perpendicular to the longitudinal direction of the elongate body 12, the retention means may also be used with the slot arrangement of FIGS. 10 to 12. Alternatively, the retention means 402 may also be used with the coupling arrangement show in FIGS. 4 to 6. In the combination, it is envisaged that once the ends 36, 38 pass through the apertures, they are shaped away from the perpendicular. Whilst FIGS. 16 to 18 show one form of the retention means 402, it is envisaged that other retraining means 402 arrangements may be used, for example, the ends 36, 38 may be bulbous at their extremities. In this arrangement, it is envisaged that the size of the bulbous portion would allow them to pass through the center of the slot, but once the two ends move apart to the two discreet points 104, 106 respectively, the width of the slot could be reduced such that the bulbous ends can no longer pass through. External retention means 402 could also be attached to the ends 36, 38 once the gate 26 has been coupled to the flange 14.

Where the retention means is external to the two ends of the wire, it is envisaged that the gate is coupled to the flange and then the retention means is applied to the two ends of the wire. Where the retention means is integrally formed with the two end of the wire gate, it is envisaged that the retention means allows for the gate to be coupled to the flange, but then inhibits uncoupling once the gate is coupled to the flange.

The engaging end 32 abuts an outer edge 44 of the wire retaining cavity 24 when in the closed configuration. The point at which the engaging end 32 abuts the outer edge 44 wire retaining cavity 24 is provided with a slot 46 shaped to receive the engaging end 32.

The width of each wire receiving channel 20 is between 1.5 and 4 mm greater than the diameter of the fence wire. Having the width of the wire receiving channel 20 greater than of the diameter of the wire, allows the wire to pass through the wire receiving channel 20 with relative ease.

The width of the wire retaining cavity 24 is greater than the width of the wire receiving channel 20. By providing the wire retaining cavity 24 at a greater width than the width of the wire receiving channel 20, it is envisaged that the wire will easily transition from the wire receiving channel 20 to the wire retaining cavity 24. The difference the diameter of the wire retaining cavity 24 and the width of the wire receiving channel 20 will also assist in retaining the wire fence in the wire retaining cavity.

The length of the wire retaining cavity 24 is at least three times the width of the wire receiving channel 20.

The wire receiving channels 20 and respective wire retaining cavities 24 are spaced equally along the length of the wire retaining fence post 400, for example at 50 mm intervals.

In use, an installer (not shown) will install the fence post into the ground in an upright position. The fence wire is strung perpendicular to the post between multiple wire retaining fence posts. As best seen in FIG. 17, the particular arrangement of the present invention allows for a fence wire 48 to be manually forced through the wire receiving channel 20, forcing the gate 26 into an open position so that the fence wire may pass to the wire retaining cavity 24. At seen in FIG. 18, once the fence wire is positioned within the wire retaining cavity 24, the bias of the gate 26 will return it to a closed position, thereby securing the wire fence within the wire retaining cavity 24.

Modifications and variations such as would be apparent to the skilled addressee are considered to fall within the scope of the present invention.

The invention claimed is:

1. A wire retaining fence post adapted to receive a wire fence, the wire retaining fence post comprising: an elongate body; at least one flange extending from the elongate body, the flange being provided with a wire receiving channel located in a distal edge of the flange, the wire receiving channel being in communication with a wire retaining cavity provided through the flange; and a gate pivotably coupled to the flange across the wire receiving channel, wherein the gate is operable in a closed configuration and an open configuration, and wherein the gate comprises a wire having two ends, in a looped arrangement, and wherein the two ends of the gate are offset from one another in a direction substantially perpendicular to the longitudinal direction of the elongate body such as to provide a bias towards the closed configuration.

2. A wire retaining fence post according to claim 1 wherein the gate has two ends that are distal to one another.

3. A wire retaining fence post according to claim 1, wherein the gate is directly coupled to the flange.

4. A wire retaining fence post according to claim 1 wherein, the gate has a pivot end and an engaging end.

5. A wire retaining fence post according to claim 4, wherein the pivot end is pivotably mounted to the elongate body at a pivot region.

6. A wire retaining fence post according to claim 4, wherein the engaging end abuts an edge of the wire retaining cavity when the gate is in the closed configuration.

7. A wire retaining fence post according to claim 6, wherein the wire retaining cavity is provided with a recess shaped to receive the engaging end.

8. A wire retaining fence post according to claim 1, wherein two ends of the wire essentially marry to form the gate.

9. A wire retaining fence post according to of claim 1, wherein the two ends pass perpendicularly through the flange in opposite directions at two discrete points.

10. A wire retaining fence post according to claim 1, wherein the two ends of the wire are provided with a retention means.

11. A wire retaining fence post according to claim 10, wherein the retention means acts to inhibit the gate from uncoupling from the flange.

12. A wire retaining fence post according to claim 10, wherein the retention means is integrally formed with the two ends of the wire.

13. A wire retaining fence post according to claim 10, wherein the retention means is fastened to the two ends of the wire.

14. A wire retaining fence post according to claim 12, wherein the retention means is provided in the form of a bend in at least one of the two ends of the wire.

15. A wire retaining fence post according to claim 14, wherein the bend is in a direction away from the direction in which the ends of the wire pass through the flange.

16. A wire retaining fence post according to claim 14, wherein the bend is in a direction 90 degrees away from the direction in which the ends of the wire pass through the flange.

17. A wire retaining fence post according to claim 1, wherein the gate is directly coupled to the flange at a slot.

18. A wire retaining fence post according to claim 17, wherein the slot extends in a direction that is substantially perpendicular to the elongate body.

19. A wire retaining fence post according to claim 17, wherein the slot extends in a direction between perpendicular and parallel to the elongate body.

20. A wire retaining fence post according to claim 1, wherein the wire receiving channel is substantially perpendicular to a longitudinal axis of the elongate body.

21. A wire retaining fence post according to claim 1, wherein the wire retaining cavity is an elongate spacing extending parallel to the longitudinal length of the elongate body.

22. A wire retaining fence post according to claim 1, wherein the wire receiving channel and the wire retaining cavity essentially form an "L" shape.

* * * * *